US006583708B1

(12) United States Patent
Smith et al.

(10) Patent No.: US 6,583,708 B1
(45) Date of Patent: Jun. 24, 2003

(54) FUSE CUTOUT WITH INTEGRATED LINK BREAK LEVER AND FUSE LINK EJECTOR

(75) Inventors: Richard W. Smith, Mexico, MO (US); Donald E. Weaver, Mexico, MO (US); Gerald B. Roberts, Paris, MO (US)

(73) Assignee: Hubbell Incorporated, Orange, CT (US)

( * ) Notice: Subject to any disclaimer, the term of this patent is extended or adjusted under 35 U.S.C. 154(b) by 142 days.

(21) Appl. No.: 09/617,095

(22) Filed: Jul. 14, 2000

(51) Int. Cl.[7] ..... H01H 71/20; H01H 71/10; H01H 85/042

(52) U.S. Cl. ..... 337/169; 337/172; 337/174; 337/175; 337/292; 361/104; 361/115

(58) Field of Search ..... 337/159, 161–164, 337/168–175, 186, 228, 292; 361/102, 104, 115

(56) References Cited

U.S. PATENT DOCUMENTS

| | | | | |
|---|---|---|---|---|
| 2,074,913 A | | 3/1937 | Johnson | |
| 2,835,764 A | * | 5/1958 | Earle | 337/177 |
| 2,836,681 A | * | 5/1958 | Bracey | 337/157 |
| 3,594,676 A | | 7/1971 | Misare | |
| 3,611,240 A | * | 10/1971 | Mikulecky | 337/169 |
| 3,614,700 A | * | 10/1971 | Beard et al. | 200/48 R |
| 3,810,060 A | * | 5/1974 | Hubbard | 337/155 |
| 4,307,369 A | * | 12/1981 | Jackson, Jr. | 337/273 |
| 4,313,100 A | * | 1/1982 | Schmunk | 337/168 |
| 4,326,184 A | | 4/1982 | Murdock | |
| 4,414,527 A | * | 11/1983 | Biller | 337/169 |
| 5,274,349 A | * | 12/1993 | Hassler et al. | 337/171 |
| 5,559,488 A | * | 9/1996 | Hassler et al. | 337/158 |
| 5,936,506 A | * | 8/1999 | Hassler et al. | 337/158 |

FOREIGN PATENT DOCUMENTS

| | | | | |
|---|---|---|---|---|
| EP | 593162 A1 | * | 4/1994 | H01H/85/042 |
| EP | 676788 A2 | * | 10/1995 | H01H/85/042 |

OTHER PUBLICATIONS

Webster's II New Riverside University Dictionary, (copy of p. # 1262).*

* cited by examiner

*Primary Examiner*—Anatoly Vortman

(57) ABSTRACT

A fuse cutout for connection to a power source, includes a mounting having upper and lower support members extending from opposing ends of the mounting. A holder member is fixedly attached to the lower support member of the mounting and a pivot member is received in the holder member at a first pivot point. The pivot member is movable between first and second positions. A lever member, movable between non-release and release positions, has unitary first and second portions. The first portion is pivotally coupled to the pivot member. A fuseholder, movable between closed and open positions, has upper and lower ends, the lower end being pivotally coupled to the pivot member at a second pivot point. The first and second positions of the pivot member and each of the closed and open positions of the fuseholder, correspond to each of the non-release and release positions of the lever member.

37 Claims, 7 Drawing Sheets

10
227
233
190
244
225
14
228
16
18
235
223
188
208
262
204
68
224
70
226
178
168
222
166
150
152
72
24
96
170
172
176
98
174
84
92
92
266
94
84
124
128
64
62
64
22
66
116
233

FIG.3
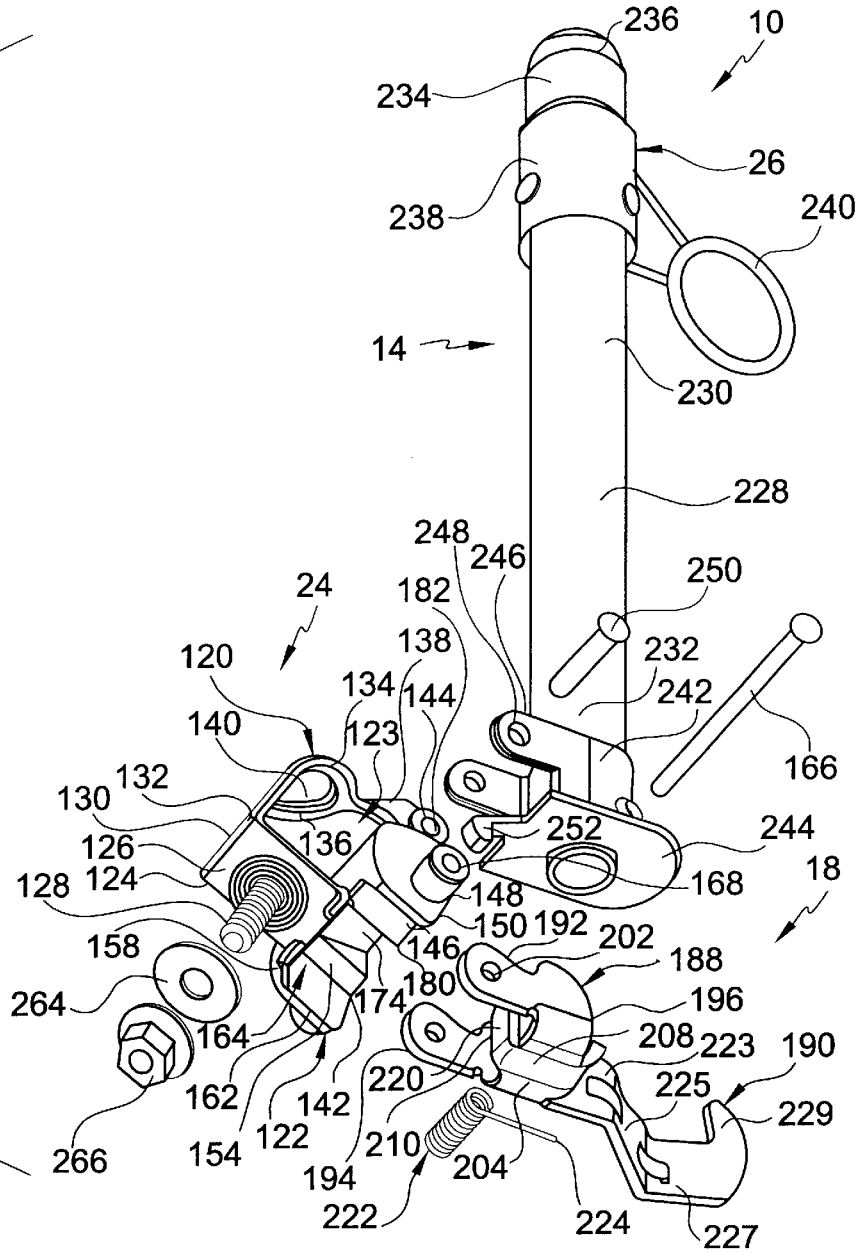
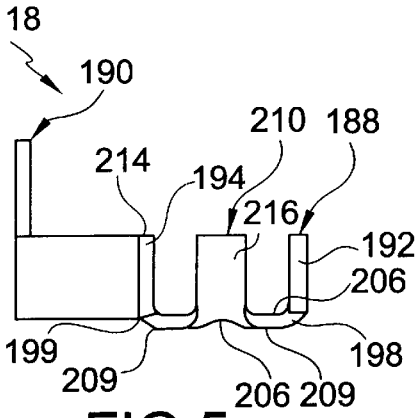
FIG.5
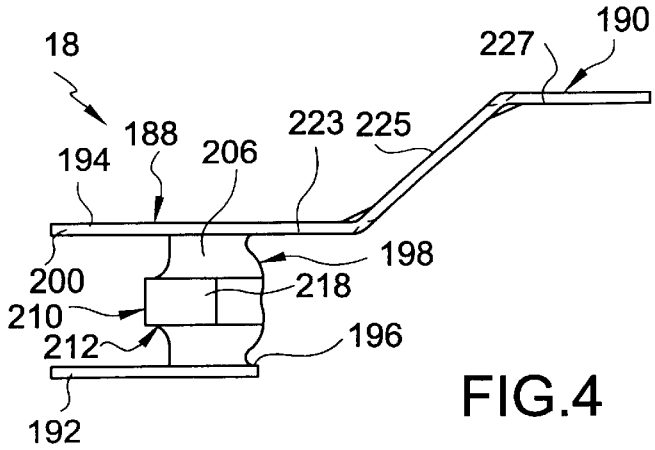
FIG.4

FUSE CUTOUT WITH INTEGRATED LINK BREAK LEVER AND FUSE LINK EJECTOR

RELATED APPLICATIONS

This application relates to commonly assigned and concurrently filed U.S. patent application Ser. No 09/617,094 of Samir F. Farag, Daren A. Clark, and Bradley W. Davis entitled Fuse Cutout With Dome Top Contact and Knurled Fuseholder cap, the subject matter of which is hereby incorporated by reference.

FIELD OF THE INVENTION

The present invention relates to fuse cutouts that can be used with power distribution systems to protect against electrical overload. In particular, the fuse cutout includes a mounting assembly, a pivotally movable fuseholder assembly received in the mounting assembly, a fuse link held within the fuseholder, and an integrated lever that serves both as a link ejector and a link break lever.

BACKGROUND OF THE INVENTION

The primary purpose of a fuse cutout is to protect power distribution systems and the various apparatus on those power lines such as transformers and capacitor banks. An over current or electrical overload in the system can occur under various conditions, such as an animal or tree contacting the power lines or more than one power line contacting each other. The fuse cutout acts to interrupt the current, and then the fuseholder of the cutout "drops", thereby preventing the voltage from being impressed across the fuseholder and providing a visual indication of operation to the utility line crew. Specifically, upon occurrence of an overload, the fuse link disposed within the fuseholder melts allowing the fuseholder to drop and interrupt the current.

Conventional cutouts typically include a mechanism for ejecting the fuse link once it has melted to avoid damage to the fuseholder. The link ejector usually comprises a spring biased member that biases the fuse link out of the fuseholder. In addition, some conventional cutouts employ a lever separate from the link ejector for manually breaking the fuse link when desired. The lever includes an outwardly extending lever arm that can be pulled down to mechanically break the fuse element.

The use of two separate members for ejecting the link and for manually breaking the link increases costs in manufacturing the cutout. Moreover, installation of the fuse link is difficult since the link must first be woven through the lever, then the lever must be pivoted away and clear from the link, and finally the link can be extended under and across the link ejector. In addition, the pressure applied due to the biasing force of the link ejector plus the mass of the link ejector and the link break lever in present designs, may cause some smaller diameter fuse links to prematurely break.

Another problem with conventional fuse cutouts is the failure to provide a mechanism for ensuring the proper installation of the fuse element. As a consequence, the fuse link could be too lose such that the fuseholder begins to drop-out just prior to the fuse link melting upon the occurrence of an overload, resulting in flashover arcing and catastrophic failure of the cutout.

Other problems with the conventional fuse cutouts are that the prior link ejectors require both the weight of the fuseholder plus the force of a top contact spring on the fuseholder in addition to the biasing force of the link ejector, to properly and efficiently eject the link during each drop out of the fuseholder. Moreover, their link break levers are too bulky and their position with respect to the fuseholder obstructs the use of tools, such as a hot stick, when attempting to manually operate the fuseholder.

Examples of such conventional fuse cutouts are disclosed in the following U.S. Pat. No.: 2,230,955 to Johnson; U.S. Pat. No. 2,269,372 to Johnson; U.S. Pat. No. 2,310,466 to Schultz et al.; U.S. Pat. No. 2,458,742 to Schultz; U.S. Pat. No. 2,584,586 to Hubbard; U.S. Pat. No. 2,862,080 to Yonkers; U.S. Pat. No. 2,910,560 to Stroup et al.; U.S. Pat. No. 3,827,010 to Cameron et al.; U.S. Pat. No. 4,542,363 to Kato et al.; U.S. Pat. No. 4,546,341 to McNaghten et al.; U.S. Pat. No. 4,774,488 to Field; and U.S. Pat. No. 4,857,879 to Morgan.

SUMMARY OF THE INVENTION

Accordingly, an object of the present invention is to provide a fuse cutout that integrates the functions of a link ejector and a link break lever into one unitary or one-piece member.

Another object of the present invention is to provide a fuse cutout that includes an integrated link break lever that reduces manufacturing costs and increasing efficiency in operating the cutout.

A further object of the present invention is to provide a fuse cutout with an integrated link break lever having a reduced mass that limits the mechanical strain on the fuse link.

Yet another object of the present invention is to provide a fuse cutout with an integrated link break lever that facilitates and ensures proper installation of the link lever, by even relatively inexperienced lineman.

A yet further object of the present invention is to provide a fuse cutout with an integrated link break lever that is unobtrusive and does not interfere with the operation of the fuseholder.

A still yet further object of the present invention is to provide a fuse cutout with an integrated link break lever that consistently ejects the fuse link upon occurrence of an overload and drop out of the fuseholder.

The foregoing objects are basically attained by a fuse cutout for connection to a power source, comprising a mounting having upper and lower support members extending from opposing ends of the mounting, respectively. A holder member is fixedly attached to the lower support member of the mounting. A pivot member is received in the holder member, the pivot member being movable between first and second positions. A lever member is movable between non-release and release positions, and has unitary first and second portions The first portion is pivotally coupled to the pivot member at the first pivot point. A fuseholder is movable between closed and open positions, and has upper and lower ends. The lower end is pivotally coupled to the pivot member at a second pivot point. A central axis extends along a length of the fuseholder. Each of the first and second positions of the pivot member and each of the closed and open positions of the fuseholder correspond to each of the non-release and release positions of the lever member, respectively.

The foregoing objects are also attained by a fuse cutout for connection to a power source, comprising a mounting having upper and lower support members extending from opposing ends of the mounting, respectively. A holder member is fixedly attached to the lower support member of the mounting. A pivot member is received in the holder member, with the pivot member being movable between first and second positions. A lever member is movable between non-release and release positions, and has unitary first and second portions and a first engaging element. The first portion is pivotally coupled to the pivot member at the first pivot point. A fuseholder is movable between closed and open positions, and has upper and lower ends. The lower end is pivotally coupled to the pivot member at a second pivot point. A central axis extends along a length of the fuseholder. A second engaging element corresponds to the first engaging element. The second portion of the lever member extends beyond the outer periphery of the fuseholder. Each of the first and second positions of the pivot member and each of the closed and open positions of the fuseholder correspond to each of the non-release and release positions of the lever member, respectively. The first and second engaging elements are engaged when the lever member and the fuseholder are in the non-release and the closed positions, respectively.

By designing the fuse cutout in this manner, the cost of manufacturing the cutout is reduced and the efficiency in using the cutout is increased. In addition, installation of the fuse link is simplified. The integrated link lever also reduces strain on the fuse link and provides consistent ejection of the fuse link upon occurrence of an overload and drop out of the fuseholder.

Other objects, advantages and salient features of the invention will become apparent from the following detailed description which taken in conjunction with annexed drawings, discloses the preferred embodiments of the present invention.

BRIEF DESCRIPTION OF THE DRAWINGS

Referring to the drawings which form a part of this disclosure:

FIG. 3 is an exploded perspective view of the fuseholder assembly of the fuse cutout illustrated in FIG. 1, showing a fuseholder, a trunnion, and a lever member;

FIG. 4 is a top plan view of the lever member of the fuse cutout illustrated in FIG. 1;

FIG. 5 is a side elevational view of the lever member of the fuse cutout illustrated in FIG. 1;

DETAILED DESCRIPTION OF THE PREFERRED EMBODIMENT

Figure 1:
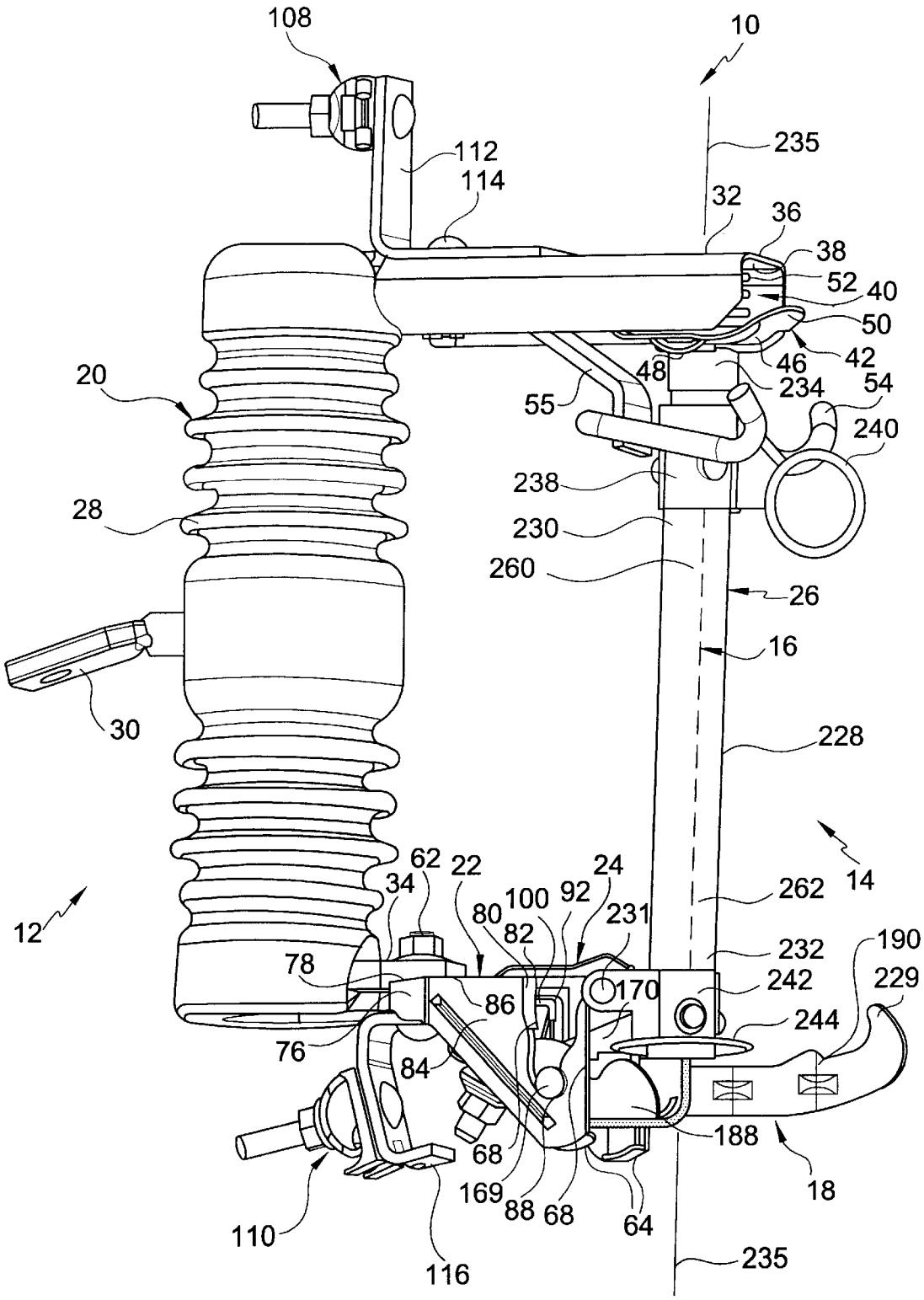
FIG. 1 is front, left side, perspective view of a fuse cutout according to a first embodiment of the present invention, illustrating a fuseholder assembly of the cutout in a closed position.
Figure 6:
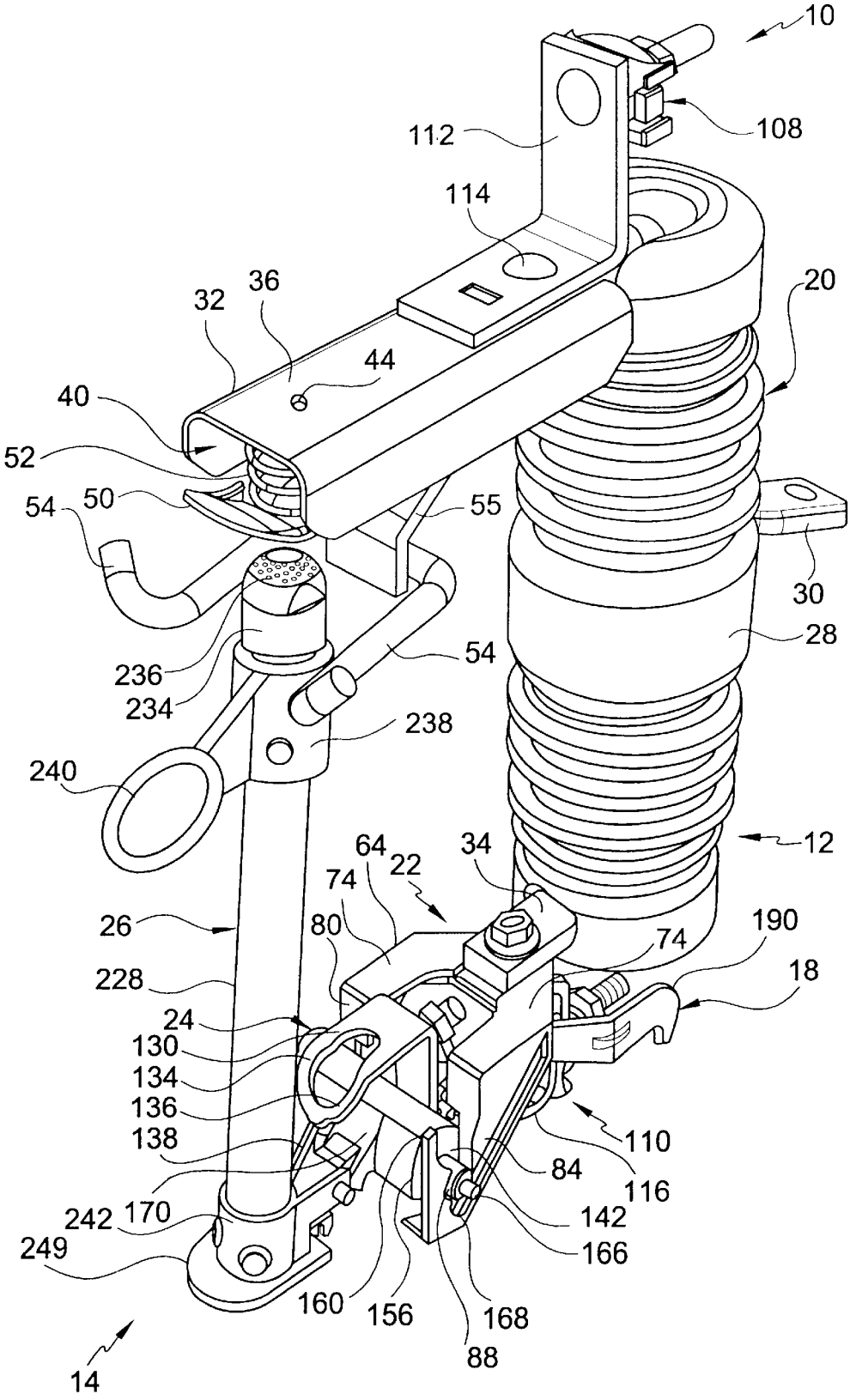
FIG. 6 is a front, right side, perspective view of the fuse cutout illustrated in FIG. 1, showing the fuseholder assembly in an open position.
Figure 7:
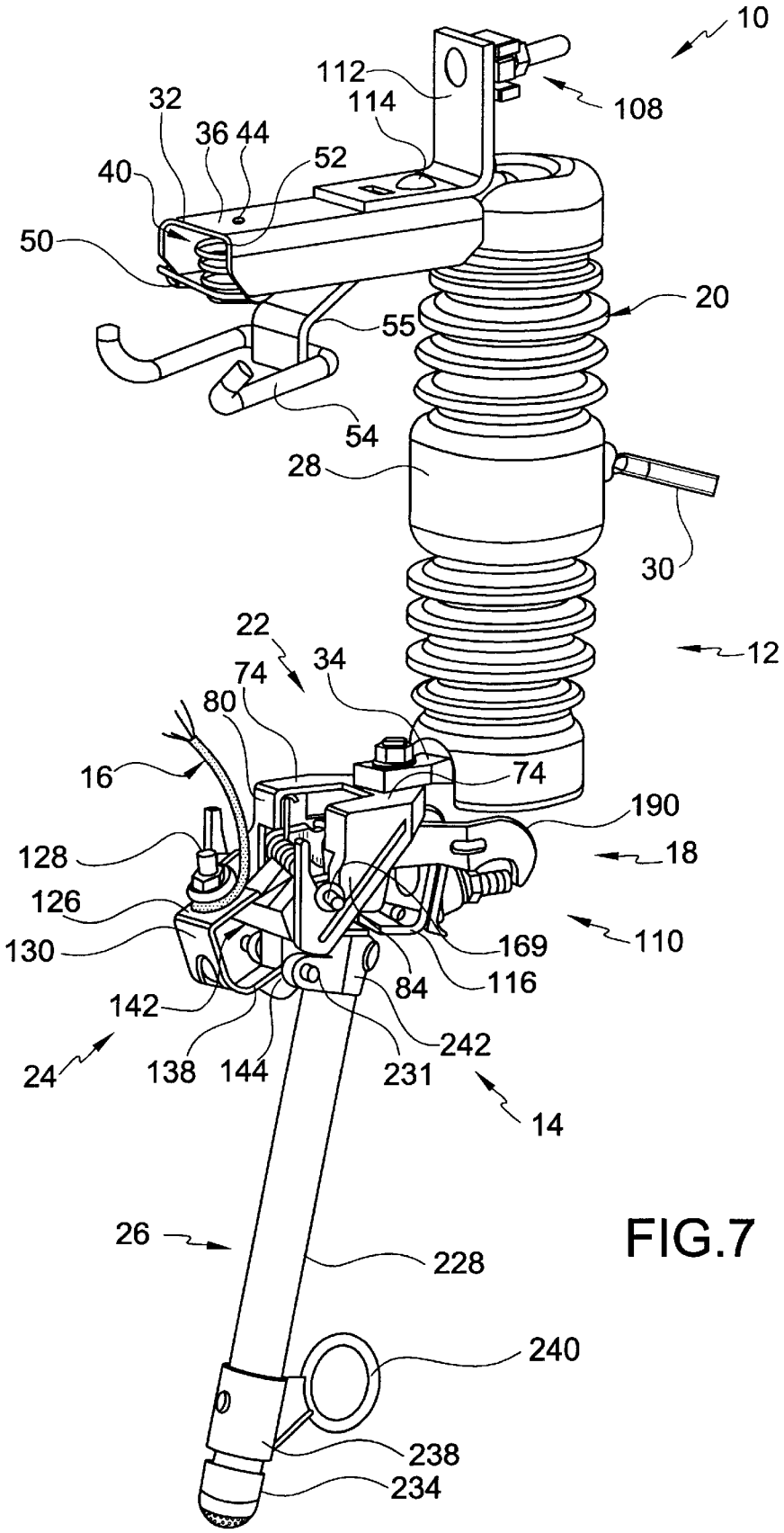
FIG. 7 is a front, right side, perspective view of the fuse cutout illustrated in FIG. 1, showing the fuseholder assembly in a drop-out position.

Referring to FIGS. 1–10, a fuse cutout 10 according to a first embodiment of the present invention comprises a mounting assembly 12 and a fuseholder assembly 14 supported by mounting assembly 12. Fuse cutout 10 generally operates as a protective device for power distribution systems. Under normal conditions, fuseholder assembly 14 of fuse cutout 10 is in a closed position, as seen in FIG. 1, allowing current to pass through the system. However, upon occurrence of an overload, fuse cutout 10 acts to interrupt the current flow. In particular, a fuse element or link 16 in fuseholder assembly 14 melts allowing fuseholder assembly 14 to drop to an open position, as seen in FIG. 6, and then subsequently to drop to a full "drop-out" position, as best seen in FIG. 7.

Fuse cutout 10 is mounted on a system support, such as a pole (not shown), via mounting assembly 12, and is typically located within a conductor. Mounting assembly 12 basically comprises a mounting 20 and a hinge or holder member 22. Fuseholder assembly 14 generally comprises a trunnion or pivot member 24, which is received in hinge member 22 once assembly 12 is mounted, and a fuseholder 26 for enclosing link 16 that is pivotally attached to trunnion 24. A lever member 18 is also included with fuseholder assembly 14 providing a mechanism for both ejecting link 16 once the fuse link 16 has melted, thereby avoiding damage to cutout 10, and functioning as a break lever to allow a lineman to manually break link 16 when desired.

Mounting 20 includes a generally cylindrical one-piece porcelain insulator or insulating member 28 with a mounting member 30 extending rearwardly therefrom for attachment to the system pole. Upper and lower support members 32 and 34 extend from opposing ends of insulator 28 in a frontward direction. Upper support member 32 extends from an extension member and includes top and bottom surfaces 36 and 38, wherein top surface 36 is substantially planar and bottom surface 38 forms a channel 40 having a cross-section that is generally an upside down U-shape. Upper support member 32 is preferably made of galvanized or stainless steel.

A top or upper contact 42 is attached to upper support member 32 by a rivet 44 and extends downwardly from bottom surface 38 so that top contact 42 is disposed in channel 40. Contact 42 basically comprises a substantially planar portion 46 having a bottom surface with a depression or cavity 48 formed therein. Cavity 48 extends upwardly into channel 40 and receives fuseholder 26 when in the closed position. A guide portion 50, is unitary with planar portion 46, extends slightly beyond upper support member 32 and is angled upwardly to provide a self-aligning action during closing of fuseholder 26. A biasing member 52 disposed in channel 40 between bottom surface 38 and contact 42, biases contact 42 downwardly to the end of rivet 44 to maintain contact pressure on fuseholder 26. Preferably, biasing member 52 is a stainless steel compression spring. Top contact 42 is described in greater detail in commonly assigned and concurrently filed U.S. patent application Ser. No. 09/617,094 of Sam F. Farag et al. entitled Fuse Cutout With Top Contact And Knurled Fuseholder Cap, the subject matter of which is hereby incorporated by reference.

Figure 8:
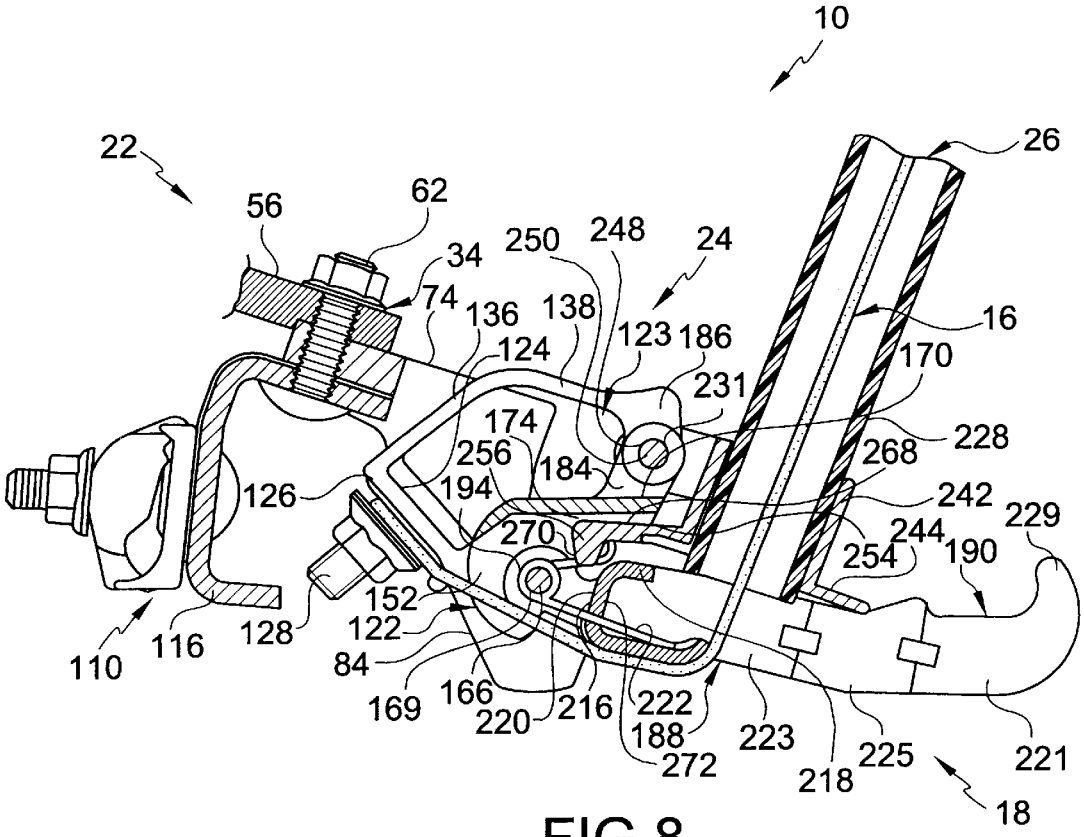
FIG. 8 is an enlarged side elevational view in section of the fuse cutout illustrated in FIG. 1, showing the fuseholder assembly in the proper closed position.
Figure 9:
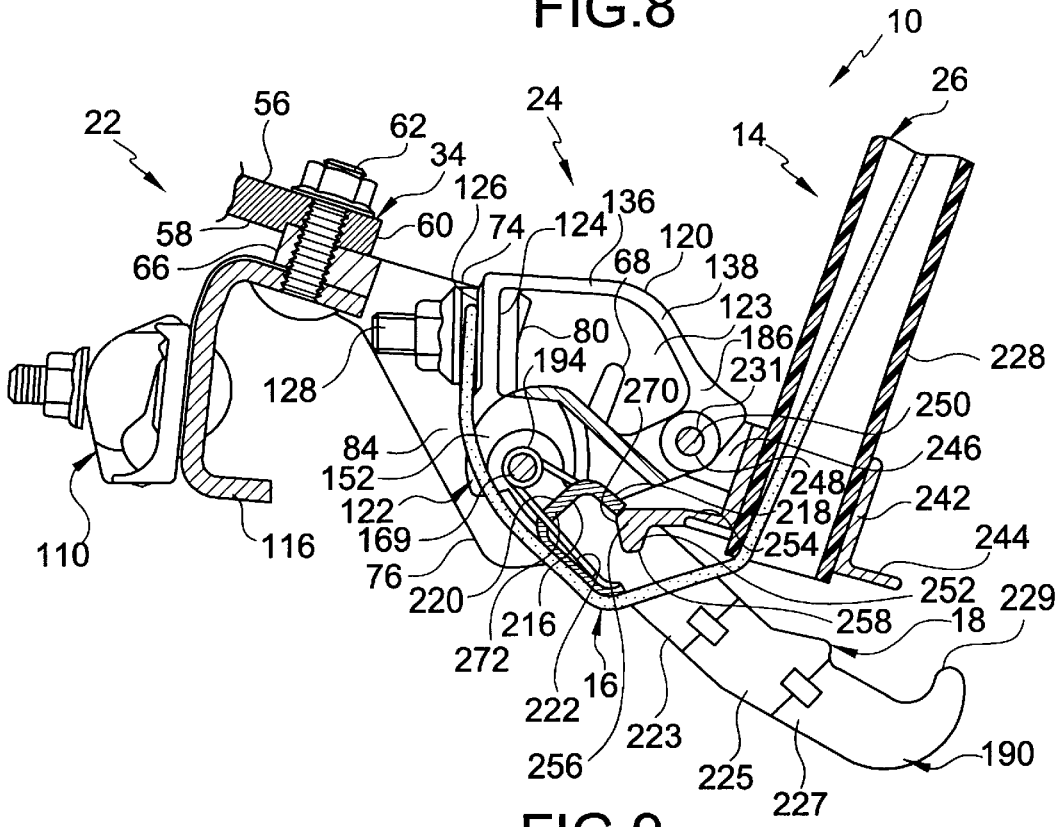
FIG. 9 is an enlarged side elevational view in section of the fuse cutout illustrated in FIG. 1, showing the fuseholder assembly in the improper closed position.

Upper support member 32 also includes two steel hooks 54 each connected at one end and attached to bottom surface 38 by a bracket 55, wherein one end of bracket 55 is attached to upper support member 32 and the opposing end is attached to hooks 54. Hooks 54 are spaced from one another such that fuseholder 26 can be easily received therebetween. The primary purpose of hooks 54 is for connection to a load break tool (not shown); however, hooks 54 also serve as a guide for fuseholder 26 upon its closing. Lower support member 34 has planar top and bottom surfaces 56 and 58, respectively, and a central hole located near the end 60 of lower support member 34 for receiving a fastener 62, such as a bolt (FIGS. 8–9). Holder or hinge member 22 is attached to bottom surface 58 of lower support member 34 by fastener 62. Lower support member 34 is also preferably formed of galvanized or stainless steel.

Figure 2:
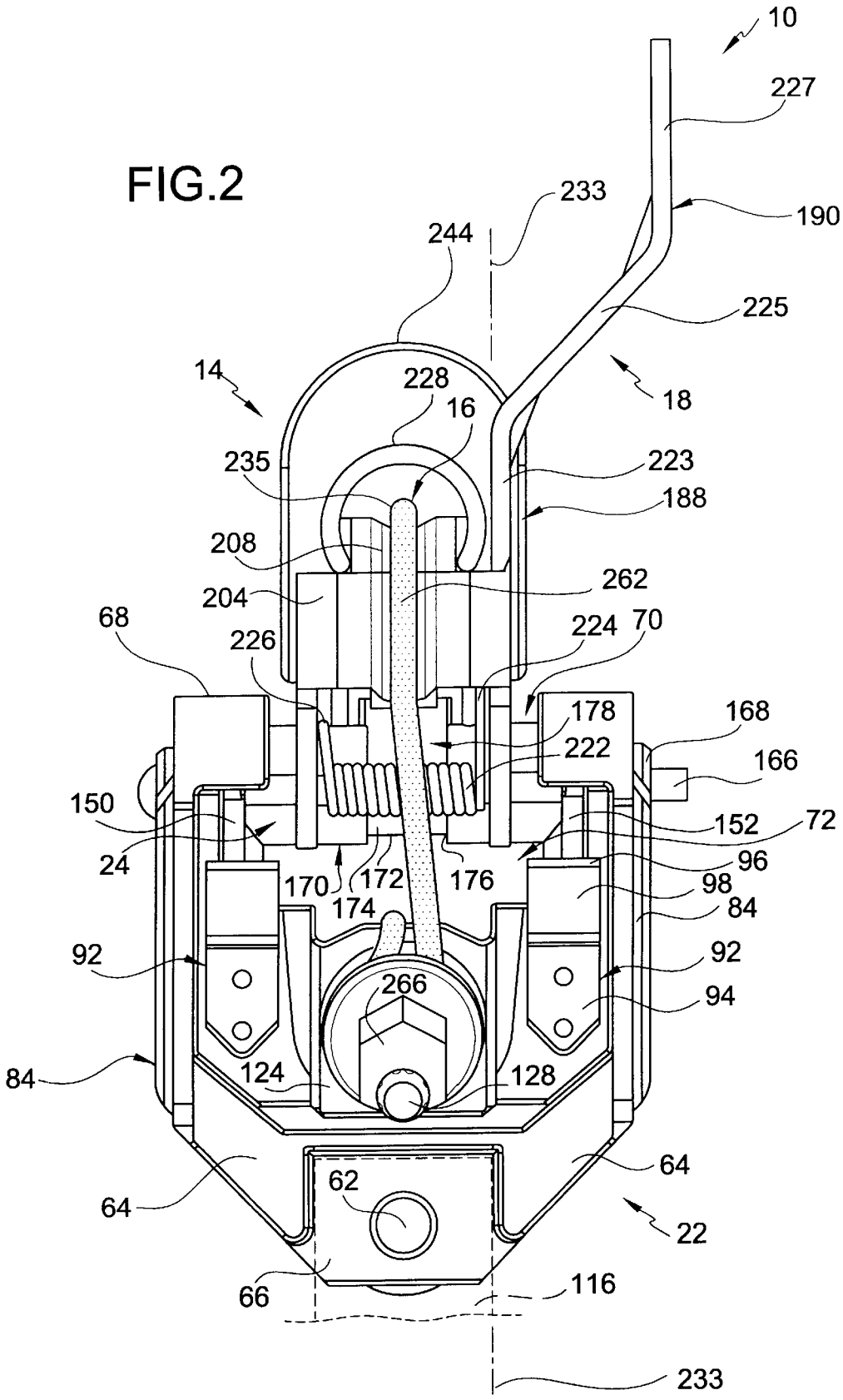
FIG. 2 is an enlarged bottom plan view of the fuseholder assembly of the fuse cutout illustrated in FIG. 1, showing attachment of a fuse link.

Hinge member 22 comprises two symmetrical parts 64 joined at their rear ends by wall 66 and open at a front end 68 forming a gap 70 between parts 64 providing an inner receiving area 72 for trunnion 24 (FIG. 2). Each part 64 includes a substantially flat top plate 74, a rear plate 76 extending downwardly from the rear edge 78 of top plate 74 and an opposing front plate 80 extending from the front edge 82 of top plate 74 (FIGS. 1 and 6). Front plate 80 extends downwardly further than rear plate 76. An outward side plate 84 extends downwardly from the outer edge 86 of top plate 74 such that side plates 84 (FIG. 1) of each part 64 are facing outwardly and enclose inner receiving area 72. Each side plate 84 has a substantially trapezoidal shape to match the differing lengths of rear and front plates 76 and 80. Extending from front plate 80 of each part 64 is a hook-type member that forms a deep U-shaped slot 88 for receiving and providing a large pivot area for trunnion 24. Slots 88 further allow trunnion 24 to be easily inserted and removed from hinge member 22. Preferably, hinge member 22 is made of a highly conductive material, such as copper. In addition, hinge member 22 can be plated with a corrosive resistant material.

As seen in FIGS. 1 and 2, each top plate 74 further includes a lower contact 92 fixedly attached thereto. Lower contact generally includes first and second end portions 94 and 96 with a middle portion 98 connecting first and second end portions 94 and 96. Each lower contact 92 includes a contact portion proximate second end portion 96 that engages trunnion 24 creating a current path. Backup springs 100 are locate behind each lower contact 92 applying pressure thereto. Preferably, each lower contact 92 is a unitary thin plate preferably formed of a highly conductive material, such as copper, and can be plated to assure low resistance current transfer from trunnion 24. Lower contacts 92 and their relation to trunnion 24 are described in greater detail in copending, commonly assigned U.S. patent application Ser. No. 09/560,816 of Gerald B. Roberts et al. filed on Apr. 28, 2000 and entitled Fuse Cutout With Mechanical Assist, the subject of which is hereby incorporated by reference.

Opposing upper and lower terminals 108 and 110 extend from mounting 20, as seen in FIGS. 1, 6, and 7. Preferably, both terminals 108 and 110 are tin-plated bronze terminals, as conventional in the art, with upper terminal 108 connected to upper support member 32 by an upper bracket 112 mated to upper support member 32 by a fastener 114. Similarly, lower terminal 110 is mated to lower support member 34 by a lower bracket 116 connected to lower support member 34 by fastener 62 with rear end wall 66 of hinge member 22 being disposed between bottom surface 58 of lower support member 34 and the top surface of lower bracket 116.

Referring to FIGS. 1–10, trunnion 24 includes an upper section 120 and a lower section 122 that form a substantially D-shaped trunnion body with an open inner area 123 that can receive a disconnecting tool for transporting fuseholder assembly 14. Upper section 120 has a substantially planar front plate 124 with an outer surface 126 and a threaded stud 128 extending outwardly from outer surface 126. A top plate 130 extends from a top end of front plate 124 in a direction opposite stud 128 forming a generally ninety-degree angle with front plate 124. Extending from a free end 132 of top plate 130 are first and second curved support arms 134 and 136 that converge into one support arm 138 which meets lower section 122 forming a generally oval opening 140 between arms 134 and 136.

Lower section 122 generally includes a camming portion 142 and a pivot portion 144. Camming portion 142 has is a generally elongated member with substantially curved inner and outer surfaces 146 and 148 forming a substantially U-shaped cross-section. First and second cams 150 and 152 extend from inner surface 146 at opposing ends of camming portion 142. Each cam 150 and 152 is a substantially U-shaped plate, each plate directly engages lower contacts 92 of hinge member 22 when fuseholder assembly 14 is mounted on mounting assembly 12, as best seen in FIGS. 1 and 2.

Camming portion 142 further includes a sidewall 154 extending between cams 150 and 152 at first edges 156, respectively, and a top wall 158 at second edges 160, respectively, such that sidewall 154 and top wall 156 join at second edge 160 leaving an opposing front edge 162 of top wall 156 free. Inner surface 146, cams 150 and 152, sidewall 154, and top wall 158 define a first receiving area 164 for accommodating a pivot pin 166. Specifically, each cam 150 and 152 includes a pin hole extension 168 through which pivot pin 166 extends providing a mechanism for pivotally coupling lever member 18 to trunnion 24 at a first pivot point 169.

A stop portion 170 extends between camming portion 142 and pivot portion 144. In particular, stop portion 170 includes a substantially planar upper wall 172 sloping downwardly from top wall 158 of camming portion 142 that has an inner stopping surface 174. Two opposing sidewalls 176 extend from either side of upper wall 172 forming a second receiving area 178 therebetween. Each sidewall 176 of stop portion 170 meets sidewall 154 of camming portion 142 with a gap 180 disposed in sidewall 154 of camming portion 142 between sidewalls 176.

Pivot portion 144 extends between stop portion 170 of lower section 122 and support arm 138 of upper section 120. Specifically, pivot portion 144 includes a central pivot hole 182 with a first end 184 extending from upper wall 178 of stop portion 170 and an opposing second end 186 meeting support arm 138.

Lever member 18 is pivotally coupled to trunnion 24, as best seen in FIG. 2, at first pivot point 169. Lever member 18 is a one-piece unitary member having first and second portions 188 and 190. First portion 188 includes first and second pivot arms 192 and 194 that are connected at one end 196 by a central plate 198 and free at their distal ends 200. In particular, central plate 198 extends between bottom edges 199 of each pivot arm 192 and 194. Each distal end 200 of first and second pivot arms 192 and 194 have a pin hole 202 for receiving pivot pin 166 coupling lever member 18 to trunnion 24. Pivot arms 192 and 194 are substantially planar with central plate 198 being generally perpendicular thereto.

Central plate 198 includes opposing first and second surfaces 204 and 206 with a central recessed groove 208 extending along first surface 204 substantially parallel to pivot arms 192 and 194. Groove 208 forms opposing slightly raised parallel sections 209 on either side thereof, as best seen in FIGS. 4 and 5. Central groove 208 provides a guide for link 16 when installing the link into fuseholder assembly 14.

A first engaging element or tab 210 extends upwardly from a first end 212 of central plate 198 in a direction towards top edges 214 of pivot arms 192 and 194. Tab 210 specifically includes first and second sections 216 and 218. First section 216 is substantially planar and extends from first end 212 at central groove 208 to about the top edges 214 of arms 192 and 194, forming a generally ninety degree angle with central plate 198 and leaving space on either side of first section 216. First section 216 also includes a first engaging surface 220 for engaging a portion of fuseholder 26. Second section 218 is also substantially planar and extends from the end of first section 216 such that second section 218 is generally parallel to central plate 198.

A biasing member 222 is placed on pin 166 between pivot arms 192 and 194 to bias lever member 18 toward a release position as best seen in FIGS. 2, 6, 7 and 10. Specifically, a first arm 224 of biasing member 222 is disposed on second surface 206 of central plate 198 of lever member 18. A second arm 226 of biasing member 222 is hooked onto sidewall 154 of camming portion 142 of trunnion 24 forcing lever member 18 toward trunnion 24 until first surface 204 of central plate 198 abuts inner surface 146 of camming portion 142.

Second portion 190 of lever member 18 defines a cantilever arm that includes three substantially planar unitary sections 223, 225, and 227. First section 223 extends from first pivot arm 194 however, it can alternatively extend from section pivot arm 192 in the same plane as pivot arm 194. Second section 225 extends from first section 223 at a substantially obtuse angle away from central plate 198, as best seen in FIG. 4. Similarly, third section 227 extends from second section 225 at a substantially obtuse angle such that first and third sections 223 and 227 extend in generally parallel planes. A hook section 229 is included on the end of third section 227 allowing a disconnect tool to hook lever member 18 when link breakage is desired.

As seen in FIGS. 1–3, and 6–10, fuseholder 26 is pivotally coupled to pivot portion 144 of trunnion 24 at a second pivot point 231 and comprises an elongated fuse tube 228 having opposing upper and lower ends 230 and 232, and a central axis 235 extending the length of fuse tube 228. Fuse tube 228 is preferably made of fiberglass and can be coated with an ultra-violet inhibitor. Upper end 230 includes a cap 234 screwed onto top tube casting 238 is preferably formed of a highly conductive material, such as copper, and can be silver plated to provide efficient current transfer. Cap 234 includes a top portion 236 for engaging cavity 48 of upper contact 42 of upper support member 32 when fuseholder 26 is the closed position. Cap 234 and its relation to top contact 42 is described in greater detail in commonly assigned and concurrently filed U.S. patent application Ser. No. 09/617,094 of Sam F. Farag et al. entitled Fuse Cutout With Top Contact And Knurled Fuseholder Cap, the subject matter of which is hereby incorporated by reference. Upper end 230 further includes a top tube casting or bracket 238 having a pull ring 240 extending therefrom in a generally frontward direction for opening and closing fuseholder 26 with conventional disconnect tools.

Lower end 232 includes a bottom tube casting or bracket 242 having a base 244 and a pair of pivot extensions 246 extending therefrom in a direction toward trunnion 24 for engaging pivot portion 144 of trunnion 24. Each pivot extension 246 includes a pin hole 248 for receiving pin 250. Pivot extensions 246 are spaced to allow pivot portion 144 of trunnion 24 to be inserted between extensions 246 such that pin hole 182 of pivot portion 144 aligns with pin holes 248 of pivot extensions 246. Pin 250 can then be inserted through pin holes 248 of fuseholder 26 and pin hole 182 of trunnion 24 connecting trunnion 24 and fuseholder 26.

Figure 10:
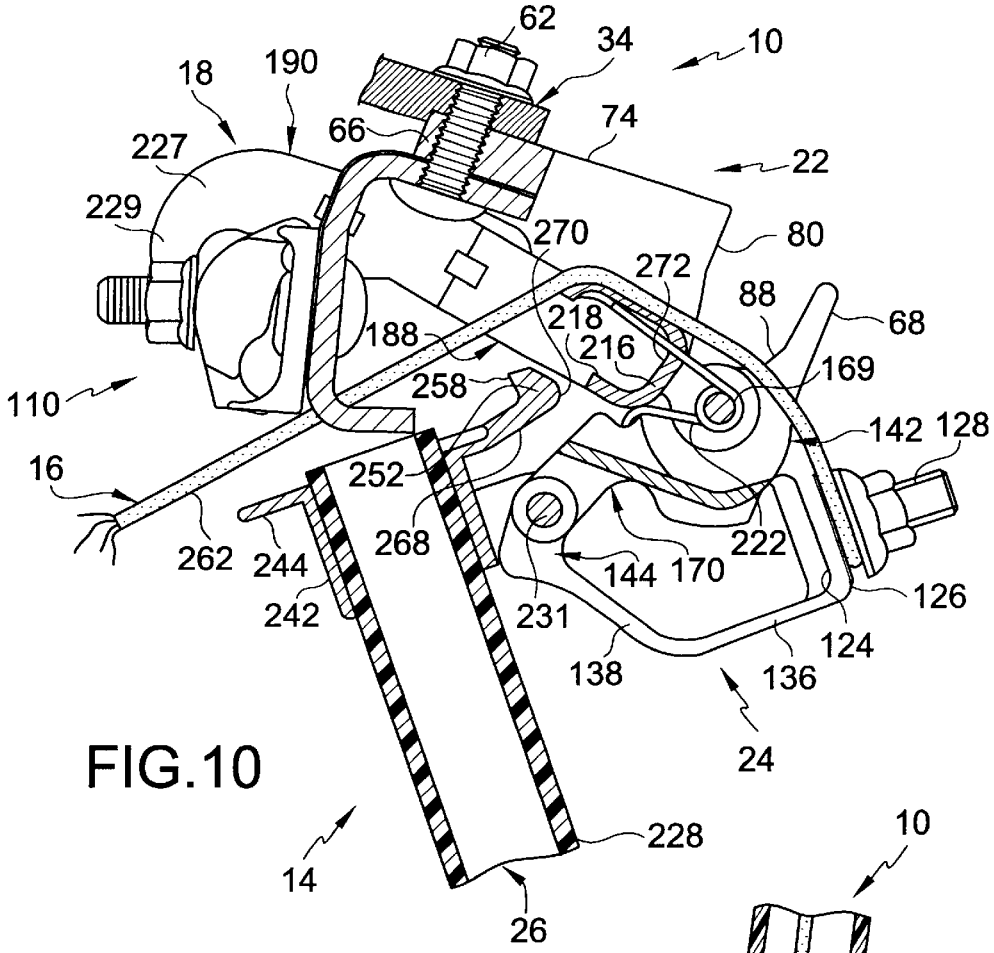
FIG. 10 is an enlarged side elevational view in section of the fuse cutout illustrated in FIG. 1, showing the fuseholder assembly in the drop-out position.

A second engaging element or hook 252 extends from base 244 for engagement with first engaging element or tab 210 of lever member 18, as best seen in FIGS. 8–10. In particular, hook 252 extends in a direction toward trunnion 24 with a first section 254 being substantially parallel to base 244 and second section 256 extending downwardly from the end of first section 254 forming a substantially ninety degree angle therewith. Second section 256 further includes a second engaging surface 258 that abuts first engaging surface 220 of tab 210 when fuseholder 26 is in the closed position.

Figure 11:
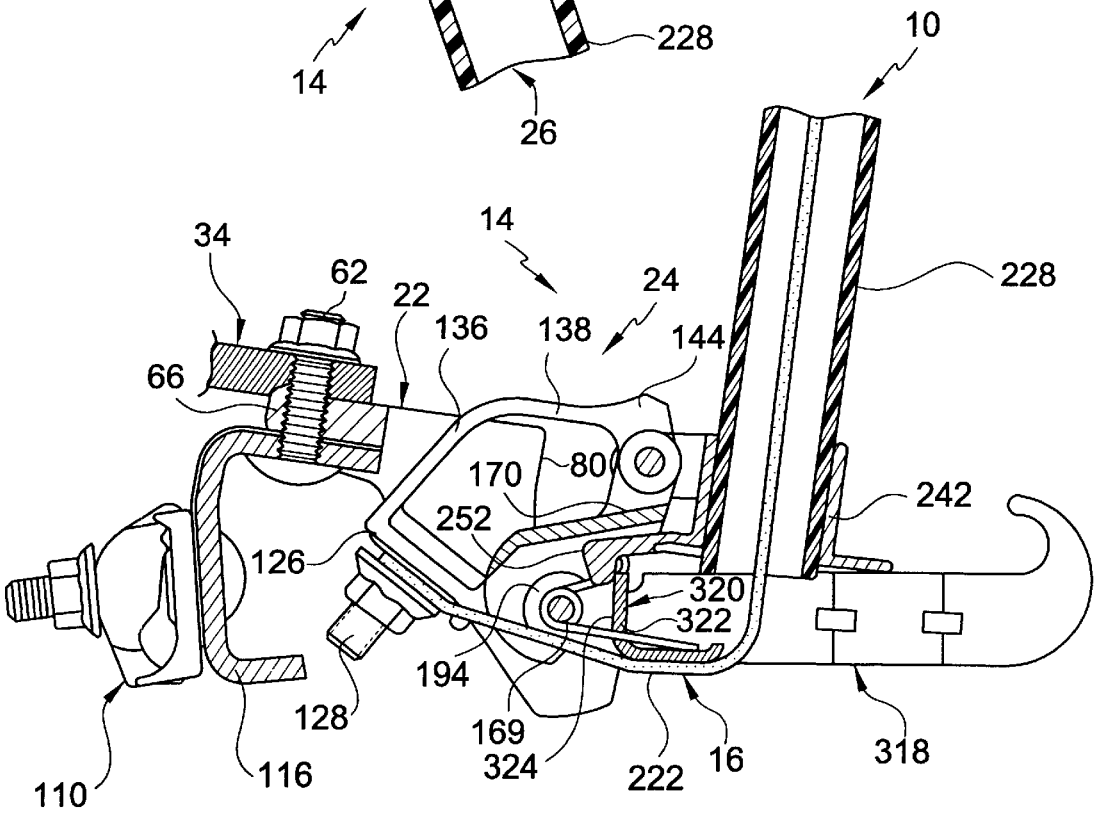
FIG. 11 is an enlarged side elevational view in section of a fuse cutout according to a second embodiment of the present invention, illustrating the fuseholder assembly in the proper closed position.

Referring to FIG. 11, a second embodiment of lever member 18, lever member 318, is substantially similar to lever member 18 and thus only the elements that vary from lever member 1 8 will be described. In particular, lever member 318 includes a engaging element 320 that employs only one upstanding section 322 thereby eliminating second section 218 of lever member 18. Upstanding section 322 is substantially planar and includes an engaging surface 324 for engagement with hook 252 of fuseholder 26.

Assembly

Referring to FIGS. 1–10, to assemble fuse cutout 10, mounting assembly 12 is first mounted to the system pole by mounting member 30 in any conventional manner. A conductor that is connected to a power source or power lines, can then be attached to upper terminal 108, in any known fashion. Lower terminal 110 can either be attached to another conductor or to a ground. Once mounting assembly 12 has been mounted, fuseholder assembly 14 can be assembled and engaged with mounting assembly 12.

Assembling fuseholder assembly 14 initially requires that trunnion 24 and fuseholder 26 be connected pivotally by pivot pin 250 being inserted through pivot holes 248 of fuseholder 26 and pivot hole 182 of trunnion 24, as described above. Once trunnion 24 and fuseholder 26 have been coupled, fuse link or element 16 can then be inserted into fuse tube 228 of fuseholder 26 along its central axis 235 and connected to trunnion 24. Fuse link 16 is preferably any fuse link known in the art.

In particular, fuse link 16 is dropped into fuse tube 228 until the button head (not shown) on a first or upper portion 260 of fuse link 16 abuts upper end 230 of fuse tube 228. Cap 234 is then screwed onto upper end 230 until an inner surface of cap 234 abuts the button head, securing fuse link 16 in fuse tube 228. A second or lower portion 262 of fuse link 16, extends through lower end 232 of fuse tube 228, can then be attached to trunnion 24.

Attaching fuse link 16 only requires a few simple steps. First, lever member 18 is pivoted against the bias of biasing member 222 to a non-release position, as seen in FIG. 1, such that lever member 18 extends along an axis 233 that is spaced from and to the side of central axis 235 and just below fuseholder 26. Then the lower portion 262 of fuse link 16 is extended across central plate 198 of lever member 18 along groove 208 and then wrapped around stud 128 of trunnion 24, as best seen in FIG. 8. A washer 264 and a nut 266 can then be applied and tightened onto stud 128 securing fuse link 16 thereto. The structure and design of lever member 18 allows a lineman to properly position the fuse link 16 with respect to lever member 18 in one step, as described above, rather than having to first pivot a break lever, then weave the fuse link through the break lever, and then place the fuse link against a biased link ejector, as is required by present fuse cutouts.

Central plate 198 of lever member 18 applies pressure on element 16 biasing element 16 out of fuseholder 26. Since lever member 18 integrates two parts, a link ejector and a break lever, the total mass is reduced thereby reducing the weight and strain on fuse link 16, thus substantially preventing accidental breakage of fuse link 16.

Once fuse link 16 is attached, trunnion 24 is secured in its first position and lever member 18 in its non-release position, such that trunnion 24 and fuseholder 26 form a substantially rigid body. In particular, hook 252 of fuseholder 26 is disposed in second receiving area 178 of trunnion 24 with stopping surface 174 either abutting or being slightly spaced from an upper surface 268, thereby preventing trunnion 24 and lever member 18 from pivoting in a counter clockwise direction away from fuseholder 26. In addition, tab 210 of lever member 18 engages hook 252 of fuseholder 26 preventing trunnion 24 and lever member 18 from pivoting in a clockwise direction towards fuseholder 26.

Similarly, in the second embodiment, tab 320 of lever member 318 engages hook 252 of fuseholder 26. Specifically, hook 252 abuts engaging surface 324 of tab 320, as seen in FIG. 11.

It is important that fuse link 16 be installed correctly to avoid damage to the fuse cutout. In particular, fuse link 16 must be tight enough to ensure that fuseholder assembly 14 is substantially rigid thereby avoiding dropping of fuseholder 26, when engaged with mounting assembly 12, prior to the melting of fuse link 16, as will be described further below.

The structure of tab 210 and hook 252 provides a mechanism for ensuring proper installation of fuse link 16. As seen in FIG. 8, second section 218 of tab 210 guides hook 252 behind tab 210 such that first and second engaging surfaces 220 and 258 of tab 210 and hook 252, respectively, abut one another, properly positioning lever member 18 with respect to trunnion 24 and fuseholder 26. Therefore, when fuse link 16 is tightened around lever member 18, it is in the correct position.

However, as seen in FIG. 9, if tab 210 accidentally slips behind hook 252, the orientation of lever member 18 provides a visual indication that fuse link 16 has been incorrectly installed. Specifically, second section 218 of tab 210 provides a stopping surface 270 with opposite second engaging surface 258, thereby preventing hook 252 from engaging the surface 272 opposite first engaging surface 220. This in turn forces lever member 18 to extend at an approximately 45 degree angle providing a visual indication that fuse link 16 has not been properly installed.

Once, fuseholder assembly 14 becomes a substantially rigid body after attaching fuse link 16, it can then be mounted to mounting assembly 12. Specifically, by inserting a disconnect stick through open inner area 123 of trunnion 24, fuseholder assembly 14 can be placed in mounting assembly 12 by inserting trunnion 24 in hinge member 22 of mounting assembly 12. Specifically, extension pins 168 of trunnion 24 engage slots 88 of hinge member 22, allowing trunnion 24 to rotate freely with respect to hinge member 22. In addition, lower contacts 92 of hinge member 22 engage camming portion 142 of trunnion 24 to create a current path during closing of fuseholder assembly 14 into mounting 12.

The weight of fuseholder assembly 14 will drop fuseholder 26 to its full drop-out position. Fuseholder 26 can then be closed by inserting the disconnect stick into pull ring 240 of fuseholder 26 and rotating fuseholder 26 to the closed position. Hooks 54 of mounting 20 act as guide when closing fuseholder 26 as well as guide portion 50 of upper contact 42. The cavity 48 in upper contact 42 engages top portion 236 of cap 234 of fuseholder 26 with biasing member 52 applying downward pressure on upper contact 42 holding fuseholder 26 in place. Since lever member 18 is disposed to the side of fuseholder 26, lever member 18 does not obstruct the use of disconnect tools, allowing a lineman to easily rotate fuseholder 26 to its proper closed position.

Operation

Upon closing fuseholder 26, fuse cutout 10 is then operational as a protective device. As seen in FIG. 1, top portion 236 of cap 234 of fuseholder 26 engages upper contact 42, as described above, when fuseholder 26 is in the closed position. Trunnion 24 is concurrently in a first position, preferably such that first pivot point 169 is substantially lower than and nearly vertically aligned with second pivot point 231. In addition, each lower contact 92 of hinge member 22 engages cams 150 and 152 of camming portion 144 of trunnion 24 with back-up springs 100 applying pressure to lower contacts 92 and camming portion 144, as best seen in FIGS. 1 and 2.

Under normal conditions, the current is allowed to travel through fuse cutout 10 when in its closed operative position. Specifically, the current will travel from a conductor to upper terminal 108 of mounting 20, through upper support member 32, through upper contact 42 to fuse element 16 via cap 234. The current then travels through fuse element 16 to stud 128 of trunnion 24, through camming portion 144 of trunnion 24 to the parallel current paths created by lower contacts 92, through hinge member 22, and finally through lower terminal 110.

Upon occurrence of an overload, fuse element 16 will melt separating first and second portions 260 and 262 such that trunnion 24 and fuseholder 26 are no longer a rigid body. In addition, upon separation of first and second portions 260 and 262, trunnion 24 is allowed to rotate with respect to hinge member 22, dropping fuseholder assembly 14 initially to an open position, as seen in FIG. 6. However, if fuse link 16 is installed incorrectly, as may occur with the design shown in FIG. 11, upon attempting to close fuseholder 26, fuse link 16 may break or once closed the fuseholder will not properly engage top contact 42. Moreover, no visual indication would be provided to the lineman that the fuse link 16 has been improperly installed, such that fuse assembly 14 is not a rigid body, fuseholder 26 will drop prior to fuse link 26 melting causing catastrophic failure. The present design of lever member 18, as described above, prevents incorrect installation of fuse link 16, thereby ensuring that cap 234 of fuseholder 26 remains in contact with top contact 42 and will not drop until after fuse link 16 has melted.

In particular, lever member 18 is released by the separation of fuse link 16 allowing the biasing member 222 to pivot lever member 18 at first pivot point 169 to its release position, as seen in FIG. 6, with second portion 190 of lever member 18 extending in a direction generally towards mounting 20. Upon lever member 18 moving to its release position, tab 210 of lever member 18 is cleared of hook 252 of fuseholder 26 allowing fuseholder 26 to drop at second pivot point 231 to its open position. Likewise, tab 320 of the second embodiment would clear hook 252. At substantially the same time trunnion 24 rotates in a counter clockwise direction toward fuseholder 26 to a second position such that first pivot point 169 is only slightly lower and substantially horizontally aligned with second pivot point 231. Upon trunnion 24 rotating to its second position and fuseholder 26 dropping to its open position, an interruption is created.

Once fuseholder assembly 14 has initially dropped to an open position, gravity will allow fuseholder assembly 14 to drop to the full drop-out position, as seen in FIGS. 7 and 10. Trunnion 24 rotates to a third position wherein, second pivot point 231 is below first pivot point 169. Fuseholder 26 simultaneously rotates to the drop-out position such that upper end 236 and cap 234 are pointing downwardly. In addition, central plate 198 of lever member 18 forces lower portion 262 of fuse link 16 out of fuse tube 228 preventing damage to cutout 10. In particular, upon rotation of lever member 18 to its release position, central plate 198 pulls lower portion 262 of fuse link 18 out of fuse tube 228, as seen in FIG. 7 Moreover, the fuseholder assembly 14 in the drop out position visually indicates that the over current has been interrupted and that it is safe to remove fuseholder assembly 14 from mounting assembly 12 and insert a new fuse element. Subsequently, fuseholder assembly 14 can be remounted to mounting assembly 12 and closed such that fuse cutout 10 is again operational.

Lever member 18 also provides a mechanism for manually breaking fuse link 16. In particular, once fuseholder assembly 14 is in the proper closed position, a lineman can employ a tool, such as a disconnect stick, to engage hook 229 on the end of lever member 18 and pull in a downwardly direction forcing lever member 18 toward its release position. The force of central plate 198 on fuse link 16 will break the link, allowing fuseholder 26 to drop in the same fashion as described above with respect to fuse link 16 melting thereby creating an interruption.

While particular embodiments have been chosen to illustrate the invention, it will be understood by those skilled in the art that various changes and modifications can be made therein without departing from the scope of the invention as defined in the appended claims.

What is claimed is:

1. A fuse cutout for connection to a power source, comprising:

a mounting having upper and lower support members extending from opposing ends of said mounting, respectively;

a holder member fixedly attached to said lower support member of said mounting;

a pivot member received in said holder member at a first pivot point, said pivot member being movable between first and second positions;

a lever member being movable between non-release and release positions and having unitary first and second portions formed as one piece, said first portion of said lever member including a central plate with a pivot arm extending therefrom coupled to said pivot member at said first pivot point, and said second portion extending from said pivot arm of said first portion forming a cantilever arm, said first portion being pivotally coupled to said pivot member; and a fuseholder being movable between closed and open positions and having upper and lower ends, and a central axis extending along a length of said fuseholder, said lower end being pivotally coupled to said pivot member at a second pivot point, whereby said first and second positions of said pivot member and of said closed and open positions of said fuseholder, correspond to each of said non-release and release positions of said lever member, respectively.

2. A fuse cutout according to claim 1, wherein said fuseholder includes an outer periphery; and said second portion of said lever member extends beyond said outer periphery.

3. A fuse cutout according to claim 1, wherein said lever member is coupled to said pivot member at said first pivot point.

4. A fuse cutout according to claim 1, wherein said lever member includes a first engaging element, and said fuseholder includes a second engaging element corresponding to said first engaging element, said first and second engaging elements being engaged.

5. A fuse cutout according to claim 1, wherein said central plate includes a groove.

6. A fuse cutout according to claim 1, wherein a fuse element is disposed within said fuseholder, said fuse element having first and second portions, said first portion being coupled to said fuseholder and said second portion being coupled to said pivot member.

7. A fuse cutout according to claim 6, wherein when said first and second portions of said fuse element are directly connected, said fuse element supports said lever member in said non-release position such that said second portion of said lever member extends in a first direction generally away from said holder member and substantially perpendicular to said central axis of said fuseholder, whereby the engagement of a first engaging element of said lever member with a second engaging element of said fuseholder provides a visual indication of proper installation of said fuse element.

8. A fuse cutout according to claim 6, wherein when said first and second portions of said fuse element are disconnected, said lever member can pivot to said release position such that said second portion of said lever member extends in a second direction generally toward said holder member.

9. A fuse cutout according to claim 6, wherein said upper support member includes an upper contact; and said holder member includes a lower contact, said upper and lower contacts creating a current path through said fuse element.

10. A fuse cutout according to claim 9, wherein said upper support member includes a biasing member biasing said fuseholder toward said open position.

11. A fuse cutout according to claim 10, wherein said biasing element is a compression spring.

12. A fuse cutout, comprising:

a mounting having upper and lower support members extending from opposing ends of said mounting, respectively;

a holder member fixedly attached to said lower support member of said mounting;

a pivot member received in said holder member at a first pivot point, said pivot member being movable between first and second positions;

a lever member being movable between non-release and release positions and having unitary first and second portions formed as one piece, said first portion being pivotally coupled to said pivot member; and a fuseholder being movable between closed and open positions and having upper and lower ends, and a central axis extending along a length of said fuseholder, said lower end being pivotally coupled to said pivot member at a second pivot point, said second portion of said lever member extending along an axis laterally spaced from said central axis of said fuseholder, whereby said first and second positions of said pivot member and of said closed and open positions of said fuseholder, correspond to each of said non-release and release positions of said lever member, respectively.

13. A fuse cutout, comprising a mounting having upper and lower support members extending from opposing ends of said mounting, respectively;

a holder member fixedly attached to said lower support member of said mounting;

a pivot member received in said holder member at a first pivot point, said pivot member being movable between first and second positions;

a lever member being movable between non-release and release positions and having unitary first and second portions, said first portion being pivotally coupled to said pivot member;

a fuseholder being movable between closed and open positions and having upper and lower ends, and a central axis extending along a length of said fuseholder, said lower end being pivotally coupled to said pivot member at a second pivot point; and a biasing element disposed between said first portion of said lever member and said pivot member at said first pivot point biasing said lever member toward said release position, whereby said first and second positions of said pivot member and said closed and open positions of said fuseholder correspond to each of said non-release and release positions of said lever member, respectively.

14. A fuse cutout according to claim 13, wherein said biasing element is a torsional spring.

15. A fuse cutout for connection to a power source, comprising:

a mounting having upper and lower support members extending from opposing ends of said mounting, respectively;

a holder member fixedly attached to said lower support member of said mounting;

a pivot member received in said holder member at a first pivot point, said pivot member being movable between first and second positions;

a lever member being movable between non-release and release positions and having first and second portions, said first portion being pivotally coupled to said pivot member; and a fuseholder being movable between closed and open positions and having upper and lower ends, and a central axis extending along a length of said fuseholder, said lower end being pivotally coupled to said pivot member at a second pivot point, said second portion of said lever member extending along an axis spaced from said central axis of said fuseholder, whereby said first and second positions of said pivot member and said closed and open positions of said fuseholder, correspond to each of said non-release and release positions of said lever member, respectively.

16. A fuse cutout according to claim 15, wherein said fuseholder includes an outer periphery;

said second portion of said lever member extends beyond said outer periphery; and said lever member is coupled to said pivot member at said first pivot point.

17. A fuse cutout according to claim 15, wherein said first and second portions of said lever member form a one-piece unitary member.

18. A fuse cutout according to claim 17, wherein a first biasing member is disposed between said lever member and said pivot member at said first pivot point biasing said lever member toward said release position.

19. A fuse cutout according to claim 18, wherein a fuse element is disposed within said fuseholder, said fuse element having first and second portions, said first portion being coupled with said fuseholder and said second portion being coupled with said pivot member.

20. A fuse cutout according to claim 19, wherein said upper support member includes an upper contact; and said holder member includes a lower contact, said upper and lower contacts creating a current path through said fuse element.

21. A fuse cutout according to claim 19, wherein said first portion of said lever member includes a central plate with a pivot arm extending therefrom coupled to said pivot member at said first pivot point, said fuse element extending along said central plate supporting said lever member in said non-release position against the bias of said lever member when said first and second portions of said fuse element are connected.

22. A fuse cutout according to claim 21, wherein said central plate includes a recessed groove guiding said fuse element along said central plate.

23. A fuse cutout according to claim 21, wherein said second portion of said lever member extends from said pivot arm of said first portion forming a cantilever arm.

24. A fuse cutout according to claim 15, wherein said second portion of said lever member include an angled section extending in a direction away from said central axis at a substantially acute angle.

25. A fuse cutout for connection to a power source, comprising:

a mounting having upper and lower support members extending from opposing ends of said mounting, respectively;

a holder member fixedly attached to said lower support member of said mounting;

a pivot member received in said holder member at a first pivot point, said pivot member being movable between first and second positions;

a lever member being movable between non-release and release positions and having unitary first and second portions and a first engaging element, said first portion being pivotally coupled to said pivot member, said first engaging element including tab having a first engaging surface, said tab including first and second sections, said first section having said first engaging surface, and said second section extending from said first section at a substantially ninety degree angle; and a fuseholder being movable between closed and open positions and having upper and lower ends, a central axis extending along a length of said fuseholder, and a second engaging element corresponding to said first engaging element, said lower end being pivotally coupled to said pivot member at a second pivot point, said second engaging element including a hook having a second engaging surface, said first and second engaging surfaces abutting when said lever member is in said non-release position, whereby the abutment of said tab and hook provides a visual indication of proper installation of said fuse element;

whereby said first and second positions of said pivot member and said closed and open positions of said fuseholder correspond to said non-release and release positions of said lever member, respectively, and said first and second engaging elements are engaged when said lever member and said fuseholder are in said non-release and said closed positions, respectively.

26. A fuse cutout according to claim 25, wherein said fuseholder includes an outer periphery;

said second portion of said lever member extends beyond said outer periphery; and said lever member is coupled to said pivot member at said first pivot point.

27. A fuse cutout according to claim 24, wherein said first and second engaging surfaces are spaced from one another when said lever member is in said release position.

28. A fuse cutout according to claim 27, wherein said first portion of said lever member includes a central plate having opposing first and second surfaces, said tab extending from said second surface of said central plate such that said first engaging surface is substantially perpendicular to said second surface of said central plate.

29. A fuse cutout according to claim 28, wherein said central plate includes a pivot arm extending therefrom coupled to said pivot member at said first pivot point; and said second portion of said lever member extends from said pivot arm of said central plate forming a cantilever arm.

30. A fuse cutout according to claim 29, wherein said central plate includes a recessed groove along said first surface for guiding a fuse element.

31. A fuse cutout according to claim 30, wherein said first section of said tab includes a surface opposite said first engaging surface; and said hook of said fuseholder includes a surface opposite said second engaging surface, and whereby said second section of said tab prevents said surface opposite said second engaging surface on said hook from engaging said surface opposite said first engaging surface on said tab.

32. A fuse cutout according to claim 31, wherein a biasing member is disposed between said pivot arm of said lever member and said pivot member biasing said lever member toward said release position.

33. A fuse cutout according to claim 32, wherein a fuse element is disposed within said fuseholder, said fuse element having first and second portions, said first portion being coupled with said fuseholder and said second portion being coupled with said pivot member.

34. A fuse cutout according to claim 33, wherein said upper support member includes an upper contact; and said holder member includes a lower contact, said upper and lower contacts creating a current path through said fuse element.

35. A fuse cutout according to claim 33, wherein when said first and second portions of said fuse element are directly connected, said fuse element supports said lever member in said non-release position against the bias of said lever member such that said second portion of said lever member extends in a first direction generally away from said holder member and substantially perpendicular to said central axis of said fuseholder.

36. A fuse cutout according to claim 35, wherein when said first and second portions of said fuse element are disconnected, said lever member can pivot with the bias of said lever member to said release position such that said second portion of said lever member extends in a second direction generally toward said holder member.

37. A fuse cutout according to claim 36, wherein said second portion of said fuse element extends along said recessed groove of said central plate of said lever member.

* * * * *